US006467287B2

(12) United States Patent
Sjoholm et al.

(10) Patent No.: US 6,467,287 B2
(45) Date of Patent: Oct. 22, 2002

(54) VALVE ARRANGEMENT FOR A COMPRESSOR

(75) Inventors: Lars Ivan Sjoholm, Burnsville; Lee J. Erickson, Eagan; Dean William Osterman, Bloomington, all of MN (US)

(73) Assignee: Thermo King Corporation, Minneapolis, MN (US)

( * ) Notice: Subject to any disclaimer, the term of this patent is extended or adjusted under 35 U.S.C. 154(b) by 0 days.

(21) Appl. No.: 09/930,392

(22) Filed: Aug. 15, 2001

(65) Prior Publication Data

US 2002/0035839 A1 Mar. 28, 2002

Related U.S. Application Data

(60) Provisional application No. 60/225,409, filed on Aug. 15, 2000.

(51) Int. Cl.[7] ..... F25B 31/00; F25B 43/02

(52) U.S. Cl. ..... 62/193; 62/470

(58) Field of Search ..... 62/193, 470, 84; 418/87, 91, 92, 93; 210/168

(56) References Cited

U.S. PATENT DOCUMENTS

| | | | | |
|---|---|---|---|---|
| 1,171,191 A | | 2/1916 | Katogir | |
| 3,151,806 A | | 10/1964 | Whitfield | |
| 4,478,054 A | | 10/1984 | Shaw et al. | |
| 4,662,190 A | | 5/1987 | Tischer | |
| 4,913,565 A | | 4/1990 | Englund | |
| 5,134,856 A | * | 8/1992 | Pillis et al. | 62/193 |
| 5,246,357 A | | 9/1993 | Sjoholm et al. | |
| 5,509,273 A | | 4/1996 | Lakowske et al. | |
| 5,683,236 A | * | 11/1997 | Harrison et al. | 418/55.1 |
| 5,722,163 A | | 3/1998 | Grant et al. | |
| 5,975,867 A | | 11/1999 | Grant et al. | |
| 5,979,168 A | | 11/1999 | Beekman | |
| 6,205,808 B1 | * | 3/2001 | Beekman | 62/469 |
| 6,237,362 B1 | * | 5/2001 | Jang | 62/469 |
| 6,309,198 B1 | * | 10/2001 | Zamudio et al. | 418/55.6 |

* cited by examiner

*Primary Examiner*—Denise L. Esquivel
*Assistant Examiner*—Marc Norman
(74) *Attorney, Agent, or Firm*—Michael Best & Friedrich LLP

(57) ABSTRACT

A compressor and oil separator assembly for compressing a fluid includes a suction end, a discharge end, and first and second rotors rotatably mounted between the suction and discharge ends. A discharge line communicates with the discharge end, and an oil separator communicates with the discharge line. An oil sump communicates with the oil separator and an oil supply line communicates between the oil sump and the rotors. A bleed line selectively communicates between the discharge line and the oil supply line for equalizing a pressure differential between the suction end and the discharge end without causing substantial backward rotation of the rotors or displacement of oil to the rotors through the oil supply line. Preferably, the assembly further includes a valve that defines a portion of the discharge line and is also coupled to the bleed line.

20 Claims, 9 Drawing Sheets

VALVE ARRANGEMENT FOR A COMPRESSOR

RELATED APPLICATIONS

This application claims priority to provisional application Ser. No. 60/225,409, filed on Aug. 15, 2000.

FIELD OF THE INVENTION

The invention relates to compressors, and more particularly to valve arrangements for controlling the flow of fluid through compressors.

BACKGROUND OF THE INVENTION

It is known to use positive displacement compressors, and more specifically screw compressors, to compress fluids. The rotors or screws of a screw compressor are susceptible to backward rotation when the compressor is stopped because the pressure differential between the discharge side of the compressor and the suction side of the compressor naturally tends to equalize over the rotors. While the compressors can be designed to handle such backward rotation of the rotors, the noise generated by the backward-turning rotors is undesirable.

SUMMARY OF THE INVENTION

To prevent pressure equalization over the compressor, and the resultant backward rotation of the rotors, it is known to use check valves. For the purposes of this description, the compressor is described as being part of a temperature control system, however, it is to be understood that the compressor need not be used in conjunction with a temperature control system. FIG. 1 schematically illustrates a prior art refrigeration system 10. The system 10 includes a compressor (represented by the dashed box 14) having two screws or rotors 16 and a discharge line 18 through which high-pressure refrigerant and lubricating oil exit the rotors 16 at the discharge end of the compressor 14. The discharge line 18 communicates with an oil separator 22 that separates the oil from the high-pressure refrigerant. The oil returns to an oil sump 26 where it can be reintroduced into the rotors 16 via an oil supply line 30. The high-pressure refrigerant exits the compressor 14 through the oil separator 22 and travels to a condenser 34. After exiting the condenser 34, the condensed refrigerant passes through an expansion valve 38 before reaching an evaporator 42. From the evaporator 42, the low-pressure refrigerant returns to the compressor 14 and the refrigeration cycle repeats.

As seen in FIG. 1, a check valve 46 is located at the suction end of the compressor 14. The check valve 46 prevents high-pressure refrigerant from flowing back through the rotors 16 toward the lower pressure at the suction end of the compressor 14, and thereby prevents backward rotation of the rotors 16. An advantage of locating the check valve 46 at the suction end of the compressor 14 is that when the compressor 14 is shut down there is no pressure equalization over the oil system so oil will not be displaced from the oil sump 26 into the rotors 16. Rather, the pressure is equalized downstream of the discharge end of the compressor 14.

The disadvantage of locating the check valve 46 as shown in FIG. 1 is that the check valve 46 must be relatively large to prevent the high-pressure gas from taking its natural equalization path over the compressor to the lower-pressure suction end. Additionally, any pressure drop caused by the check valve 46 while the system is operating will substantially reduce the system's capacity.

FIG. 2 shows another prior art refrigeration system 10', with like parts having like reference numerals. In the system 10', a check valve 50 is located downstream of the oil separator 22. The check valve 50 prevents high-pressure refrigerant from flowing back into the oil separator 22 and the rotors 16. Locating the check valve 50 downstream of the oil separator 22 also provides advantages. First, the check valve 50 can be relatively small because the high-pressure refrigerant will naturally flow toward the lower-pressure environment of the condenser 34. In other words, because the high-pressure refrigerant downstream of the oil separator 22 does not tend to flow back into the oil separator 22, the check valve 50 can be relatively small. Additionally, any pressure drop caused by the check valve 50 while the system is operating will only affect power consumption and not system capacity.

The disadvantage with the location shown in FIG. 2 is that, in most situations, the volume of high-pressure refrigerant in the oil separator 22 is still large enough to cause noticeable backward rotation of the compressor rotors 16 as the pressure equalizes over the compressor 14. To alleviate this problem, it is known to add a second check valve 54 at the suction end of the compressor 14. This second check valve 54 operates in the manner described above with respect to the check valve 46, so that the volume of high-pressure refrigerant in the oil separator 22 does not flow back through the rotors 16. While this configuration creates maximum isolation of the compressor 14 from the remaining components of the refrigeration system 10', it necessitates the use of two check valves 50 and 54, and adds to the cost of the refrigeration system 10'.

FIG. 3 shows yet another prior art refrigeration system 10", with like parts having like reference numerals. A check valve 58 is located at the discharge end of the compressor 14, between the rotors 16 and the oil separator 22. When the compressor 14 stops running, the pressure between the discharge end and the suction end of the compressor 14 equalizes over the oil system via the oil supply line 30. The disadvantage with this check valve location is that when the pressure is equalized over the oil system, oil from the oil sump 26 is displaced into the rotors 16, the bearings (not shown), the gears (not shown), and the seal cavities (not shown). Too much oil in the rotors 16 makes the compressor 14 difficult to start and reduces the overall life of the compressor 14. For example, since oil is not a compressible medium, too much oil in the rotors 16 could create a hydraulic lock situation. To overcome these problems, it has been known to place a solenoid valve 62 in the oil supply line 30. The solenoid valve 62 is opened when the compressor 14 is running and closed when the compressor 14 is stopped.

One disadvantage with using the solenoid valve 62 is the additional cost. Furthermore, failure of the solenoid valve 62 could cause problems. For example, if the solenoid valve 62 is stuck closed when the compressor 14 is running, the compressor 14 will not get lubrication and will eventually seize. If the solenoid valve 62 is stuck open when the compressor 14 is stopped, oil will be displaced to the rotors 16, creating the difficult starting conditions that the solenoid valve 62 was intended to prevent.

The present invention provides a valve arrangement that offers many of the advantages discussed above, without most of the disadvantages. More particularly, the invention provides a valve arrangement having a single, relatively small valve located in the discharge line of the compressor. When the compressor is running, the valve provides the necessary fluid communication between the compressor and the oil separator. When the compressor is shut down, the valve blocks fluid communication between the rotors and the oil separator to prevent the high-pressure fluid from flowing back over the rotors.

In addition, the valve arrangement also prevents displacement of oil to the rotors when the compressor shuts down, and does so without the use of a solenoid valve in the oil supply line. To accomplish this, the valve arrangement includes a bleed line communicating between the oil supply line and the discharge line. When the compressor is not operating, the valve and the bleed line provide a pathway for the high and low pressure fluid to equalize over the oil cavities in the compressor while short-circuiting the oil separator and the oil sump. Because the pressure equalization does not occur over the oil sump, substantially no oil is displaced to the rotors.

The valve provides selective communication between the discharge end of the compressor, the oil separator, and the bleed line. A movable member in the valve responds to system pressure so that when the compressor is running, the movable member is in a first position that allows communication between the discharge end of the compressor and the oil separator, while blocking communication between the discharge end of the compressor and the bleed line. When the compressor is stopped, the movable member in the valve moves to a second position that blocks communication between the discharge end of the compressor and the oil separator, and allows communication between the discharge end of the compressor and the bleed line.

Other features and advantages of the invention will become apparent to those skilled in the art upon review of the following detailed description, claims, and drawings.

Figure 2:
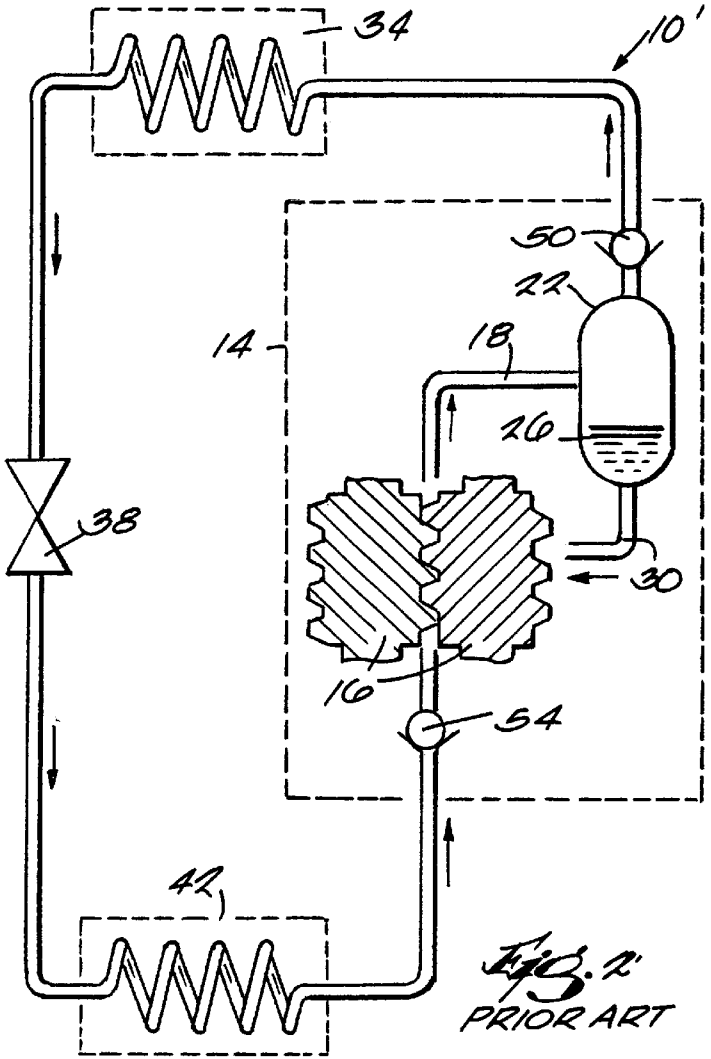
FIG. 2 PRIOR ART
FIGS. 1–3 schematically illustrate prior art temperature control systems having various check valve arrangements.
Figure 1:
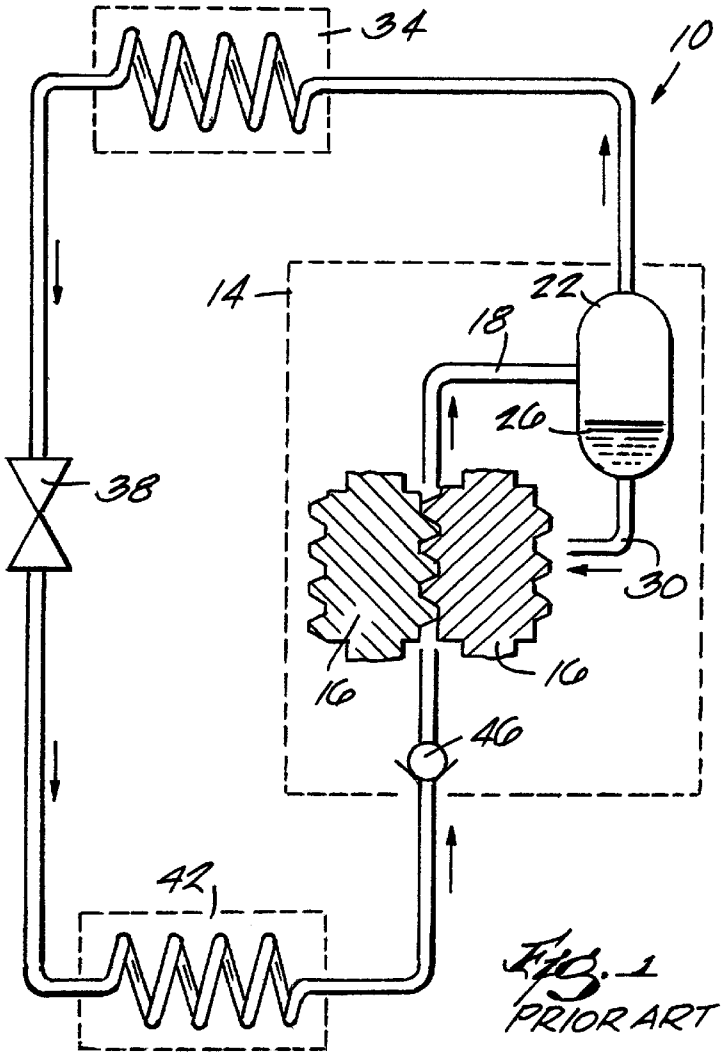
FIG. 1 PRIOR ART
Figure 3:
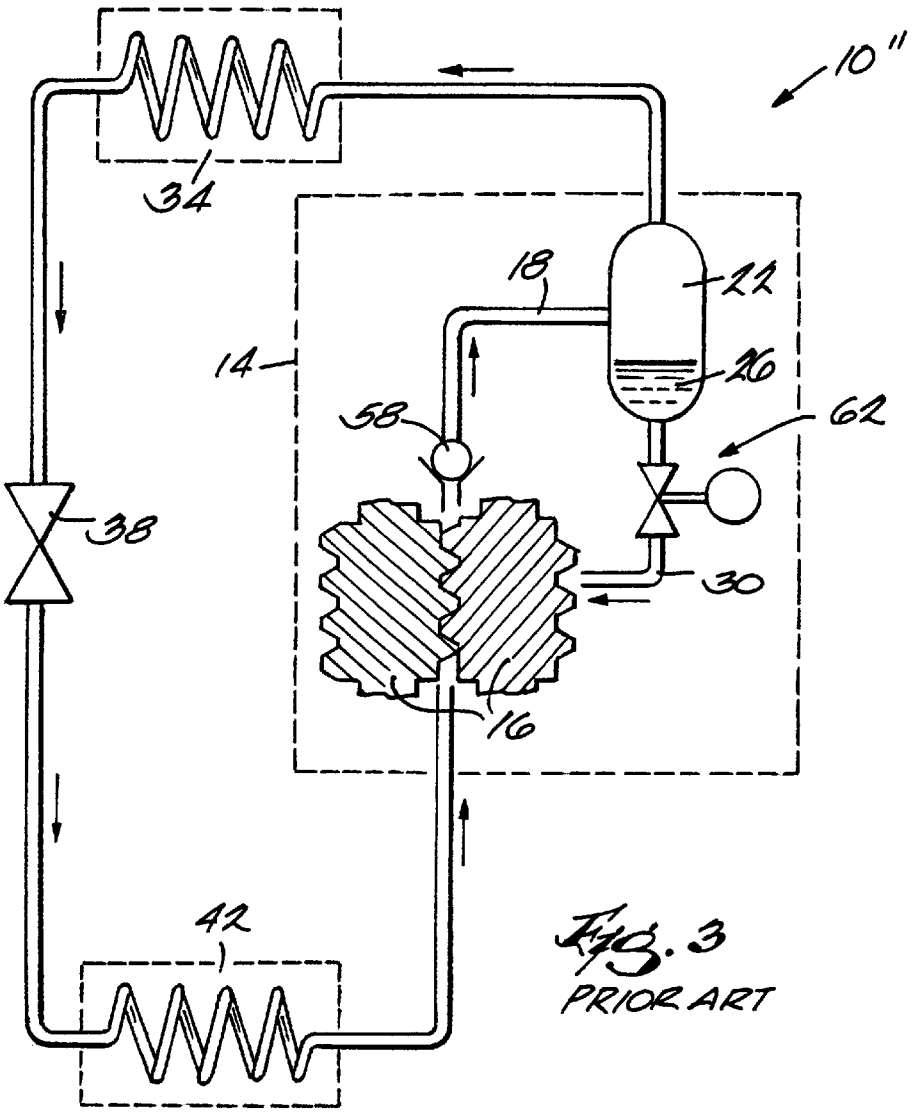
FIG. 3 PRIOR ART

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 5:
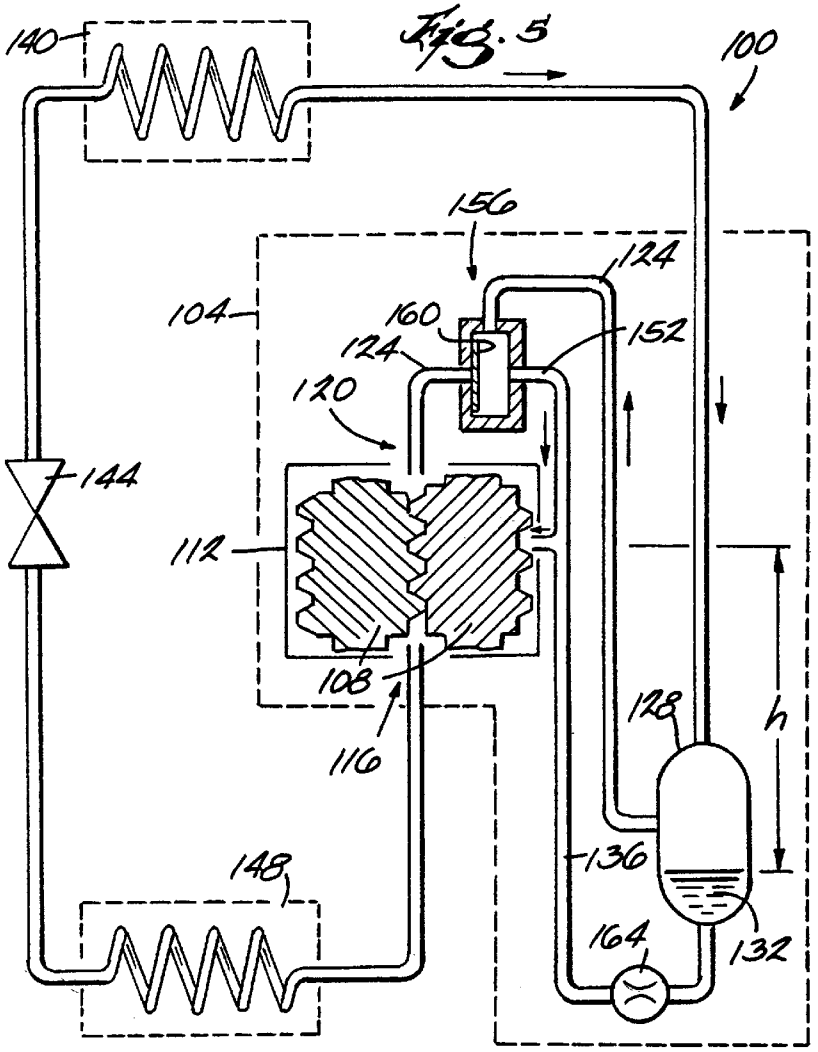
FIG. 5 schematically illustrates the temperature control system embodying the invention, shown in a state where the compressor is shut down.
Figure 4:
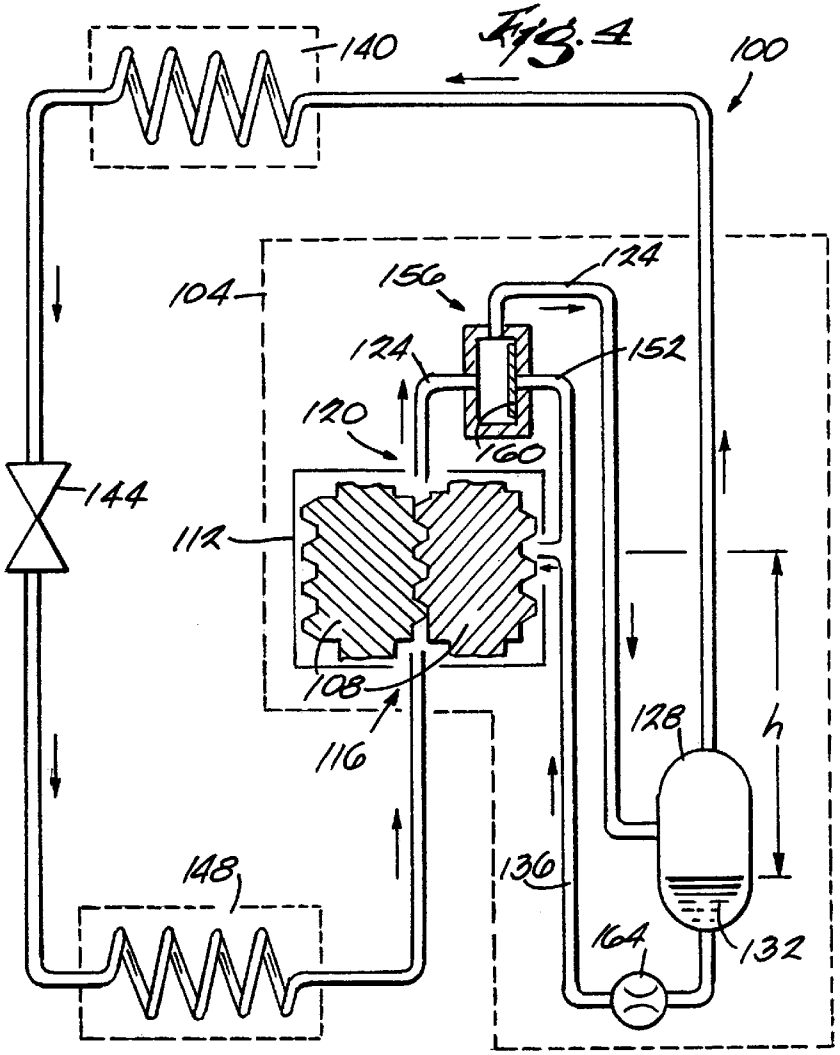
FIG. 4 schematically illustrates a temperature control system embodying the invention, shown in a state where the compressor is running.

FIGS. 4 and 5 schematically illustrate a temperature control system 100 embodying the invention. The system 100 includes a screw compressor (represented by the dashed box 104) having two screws or rotors 108 housed in a compression chamber 112 (shown schematically in FIGS. 4 and 5). As mentioned above, the compressor 104 is described as being part of the temperature control system 100, however, it is to be understood that the compressor need not be used in conjunction with a temperature control system. For example, the compressor 104 could be an air compressor or a compressor used to compress other compressible fluids.

The compressor 104 includes a suction end 116, where low pressure refrigerant enters the compression chamber 112, and a discharge end 120 having a discharge line 124, through which high-pressure refrigerant and lubricating oil (not shown) exit the compression chamber 112. The discharge line 124 communicates with an oil separator 128 that separates the oil from the high-pressure refrigerant. The oil returns to an oil sump 132 where it can be reintroduced into the compression chamber 112 and to the rotors 108 via an oil supply line 136.

FIG. 4 illustrates the temperature control system 100 when the compressor 104 is running. The high-pressure refrigerant exits the compressor 104 downstream of the oil separator 128 and travels to a condenser 140. After exiting the condenser 140, the condensed refrigerant passes through an expansion valve 144 before reaching an evaporator 148. From the evaporator 148, the low-pressure refrigerant returns to the suction end 116 of the compressor 104 and the refrigeration cycle repeats. While the compressor 104 is illustrated as having an integral oil separator 128 and oil sump 132, it is understood that the oil separator 128, the oil sump 132, and the compressor 104 could also be separate units.

In the illustrated embodiment, the compressor 104 also includes a bleed line 152 that communicates with the discharge line 124 and the oil supply line 136. A valve 156 is coupled to the discharge line 124 to define a portion of the discharge line 124. The valve 156 is also coupled to the bleed line 152. The valve 156 is movable from a first position (see FIG. 4), wherein the discharge line 124 is open to allow high-pressure refrigerant and lubricating oil to travel into the oil separator 128 when the compressor 104 is running, to a second position (see FIG. 5), wherein the discharge line 124 is closed so that high-pressure refrigerant and lubricating oil cannot travel back into the rotors 108 when the compressor 104 is shut down.

In the illustrated embodiment, the valve 156 moves automatically between the first and second positions due to the pressure differential of the refrigerant in the temperature control system 100. For example, when the compressor 104 is running (FIG. 4), the high-pressure refrigerant and lubricating oil exiting the rotors 108 enters the discharge line 124 and travels toward the oil separator 128. The valve 156 includes a movable member 160 that is moved to the first position by the high-pressure refrigerant and lubricating oil passing through the valve 156. In the illustrated embodiment, the valve 156 is a reed valve and the movable member 160 is a reed, however, other types of valves can also be used. When the reed 160 is in the first position, the bleed line 152 is closed so that the high-pressure refrigerant and lubricating oil travel through the valve 156 and to the oil separator 128. Lubricating oil flows through the oil supply line 136 to lubricate the rotors 108 and the other components (not shown) in the compression chamber 112 (i.e., the bearings, the gears, and the shaft seals).

When the compressor 104 is shut down (FIG. 5), the reed 160 is moved to the second position by the high-pressure refrigerant and lubricating oil that is trying to pass back through the valve 156 toward the lower pressure at the suction end 116. As will be described in more detail below, a biasing spring can also be used to move the reed 160 to the second position when the compressor 104 is shut down. When the reed 160 is in the second position, the discharge line 124 is blocked and the bleed line 152 is opened to provide a pathway for the high and low pressure refrigerant to equalize over the oil cavities (not shown in FIGS. 4 and 5) in the compression chamber 112, while short-circuiting the oil separator 128 and the oil sump 132. By allowing the pressure to equalize over the bleed line 152, there is little or no undesirable backward rotation of the rotors 108. In addition, because the pressure equalization does not occur over the oil sump 132, substantially no oil is displaced to the rotors 108.

To ensure that the pressure equalizes over the bleed line 152 and not over the oil supply line 136, the compressor 104 also includes a restrictor or orifice 164 in the oil supply line 136. The restrictor 164 functions to increase the pressure drop over the oil supply line 136. Compared to the oil supply line 136, the bleed line 152 has a relatively large and unobstructed cross-section, and therefore the bleed line 152 provides the path of least resistance for pressure equalization of the refrigerant.

To further ensure that equalization occurs over the bleed line 152, the oil sump 132 in the illustrated embodiment is located at a point that is lower than the point where the bleed line 152 connects with the oil supply line 136, so that the pressure drop over the oil supply line 136 is larger than the pressure drop over the bleed line 152. As shown in FIGS. 4 and 5, the oil sump 132 is located at a distance h from the point where the bleed line 152 connects with the oil supply line 136. It should be understood that restrictor 164 and the elevational difference between the oil sump 132 and the bleed line 152 may not be necessary to ensure that the pressure equalizes over the bleed line 152.

Figure 6:
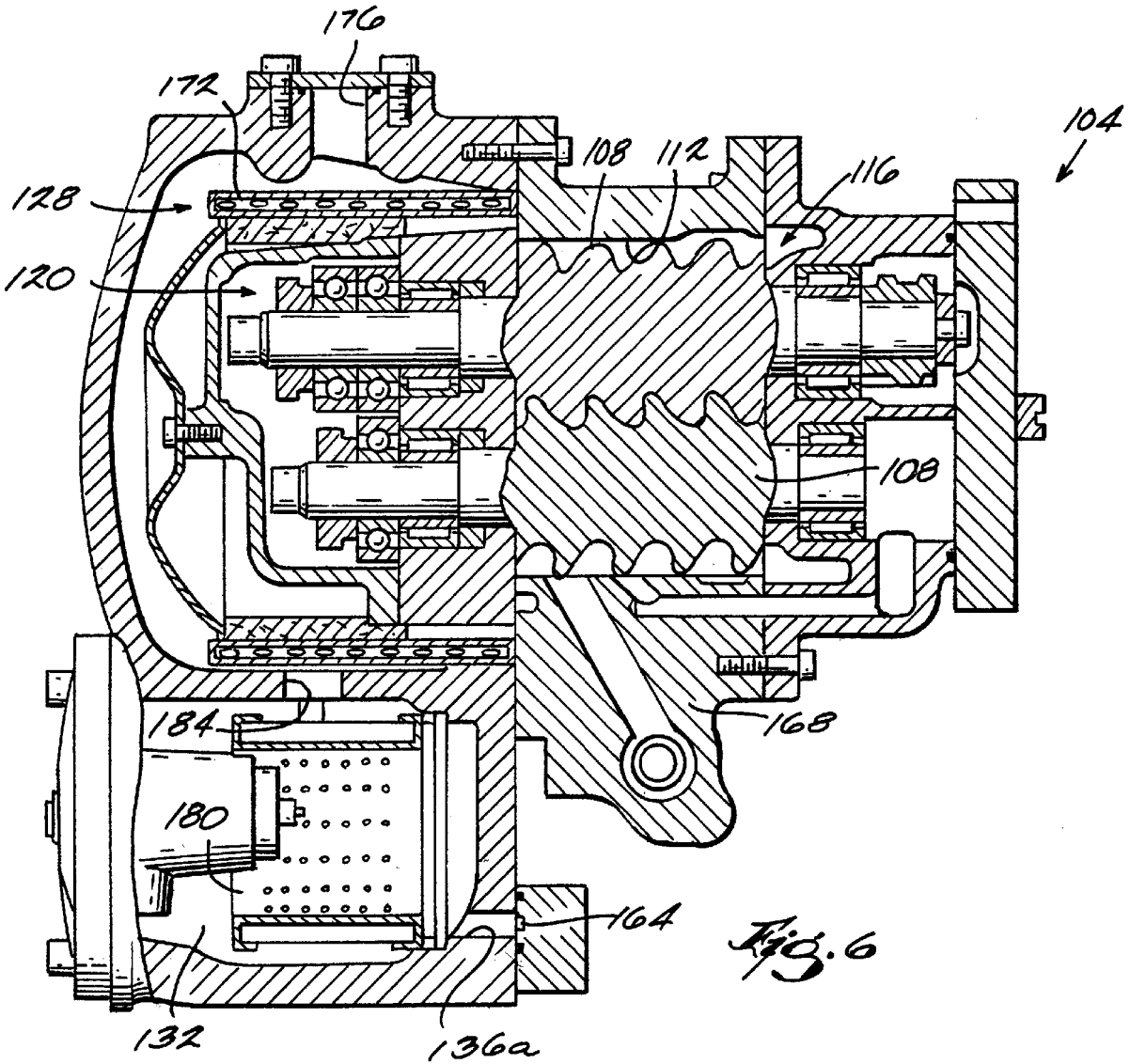
FIG. 6 is a section view of a compressor embodying the invention.

FIGS. 6–10 illustrate the invention as described above embodied in a screw compressor 104 having an integral oil separator 128 and oil sump 132. Like parts have been given like reference numerals. Referring to FIG. 6, the compressor 104 includes a housing 168 that surrounds the rotors 108 and defines the compression chamber 112. In FIG. 6, the suction end 116 is on the right side of the compressor 104 and the discharge end 120 is on the left side of the compressor 104.

The oil separator 128 includes a separator element 172 that circumscribes at least a portion of the discharge end 120. A discharge outlet 176 defined in the housing 168 provides an exit for the high-pressure refrigerant to leave the compressor 104 after the oil has been separated. The oil sump 132 is shown below the lowest portion of the separator element 172, and includes an oil filter 180 for filtering the oil returning to the oil sump 132. Oil separated by the separator element 172 drains into the oil sump 132 through passageway 184. Oil collected in the oil sump 132 travels back to the rotors 108 via the oil return line 136. A first portion 136*a* of the oil return line 136 is shown in FIG. 6. Also shown in FIG. 6 is the restrictor or orifice 164.

Figure 7:
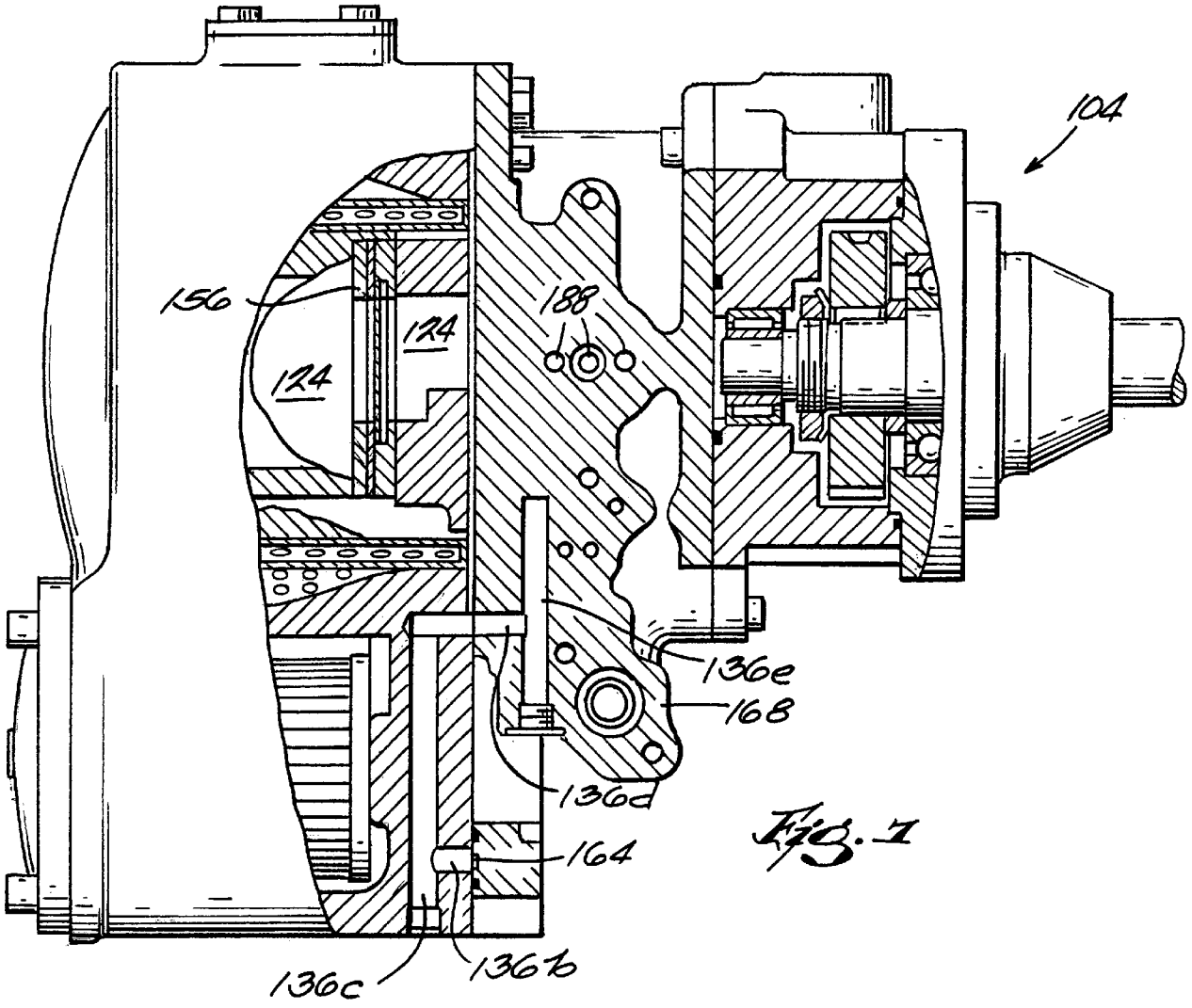
FIG. 7 is a section view of the compressor of FIG. 6, showing the valve arrangement embodying the invention.

FIG. 7 is another section view through the compressor 104. FIG. 7 illustrates more of the oil return line 136, again showing the restrictor or orifice 164, as well as second, third, fourth, and fifth portions 136*b–e*, respectively, of the oil return line 136. Oil cavities or ports 188 are shown in the housing 168 and communicate with the oil return line 136 and the compression chamber 112 to provide lubricating oil to the rotors 108 and to various other components.

FIG. 7 also shows the reed valve 156 positioned in the discharge line 124 of the compressor 104. The construction of the reed valve 156 will be described in detail below.

Figure 8:
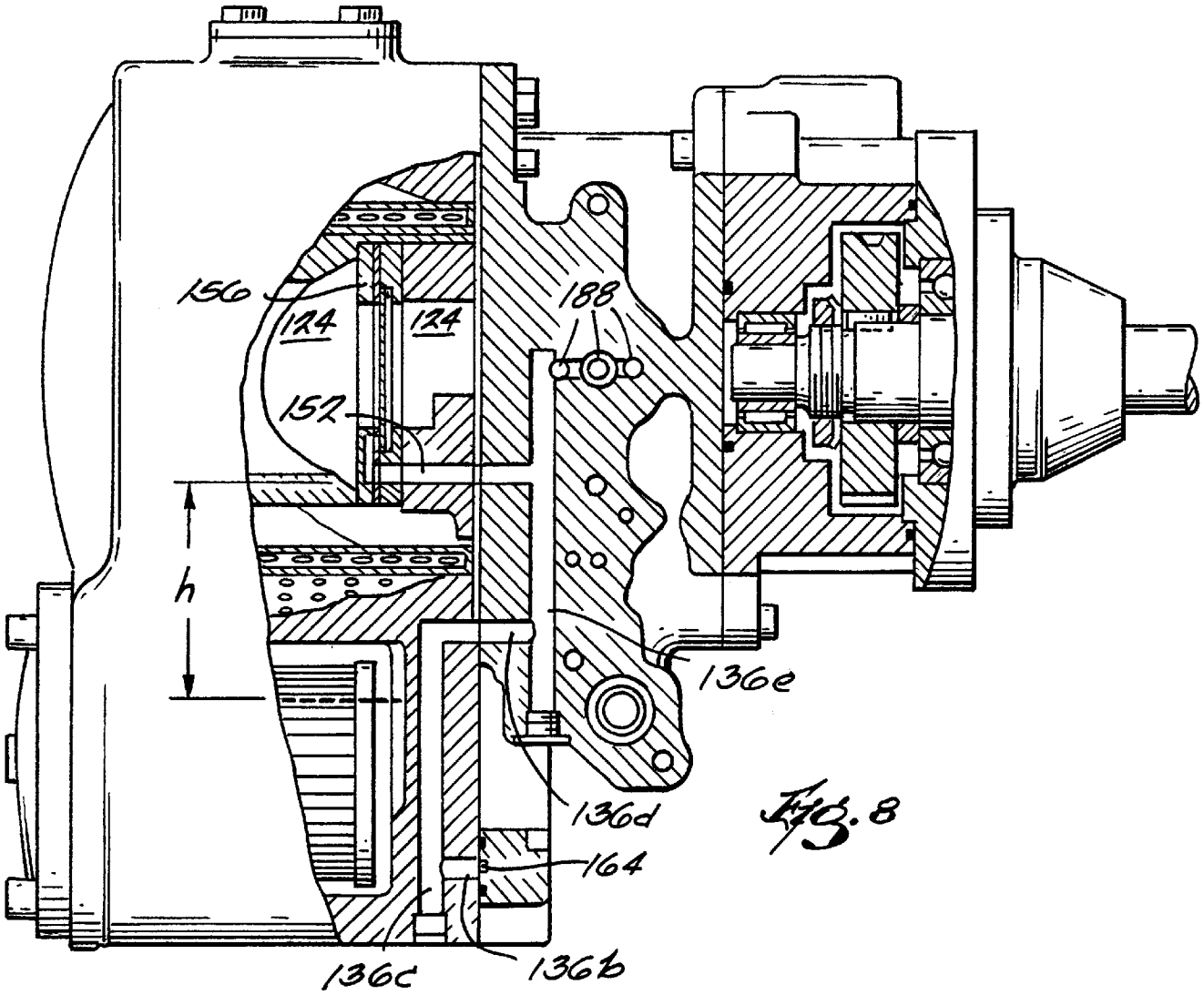
FIG. 8 is another section view of the compressor of FIG. 6, showing the oil return line and the bleed line.

FIG. 8 is yet another section view through the compressor 104. FIG. 8 illustrates how the fifth portion 136e of the oil return line 136 communicates with the oil ports 188. Additionally, FIG. 8 shows the bleed line 152 that communicates with the discharge line 124 and the fifth portion 136*e* of the oil return line 136. The bleed line 152 communicates with the discharge line 124 via the reed valve 156 in a manner that will be described in detail below. FIG. 8 also shows the distance h between the point where the bleed line 152 intersects the fifth portion 136*e* of the discharge line 136 and the oil level in the oil sump 132.

Figure 9:
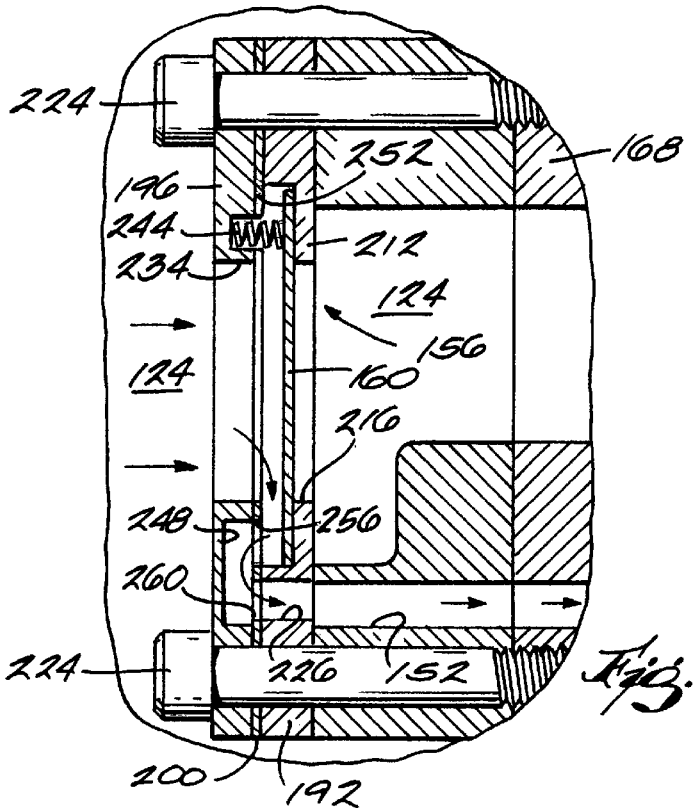
FIG. 9 is an enlarged section view, showing the valve in its closed position when the compressor is not running.
Figure 10:
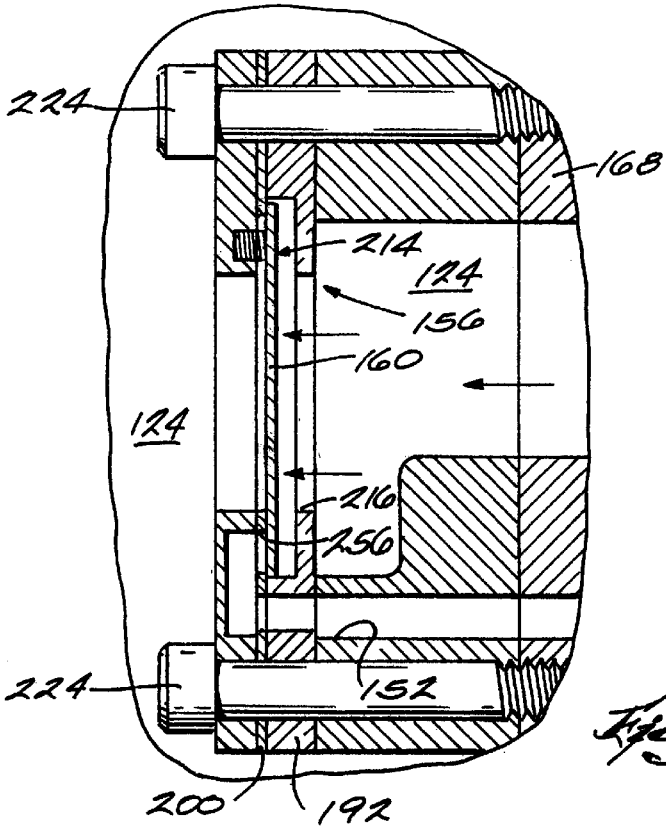
FIG. 10 is an enlarged section view, showing the valve in its open position when the compressor is running.
Figure 11:
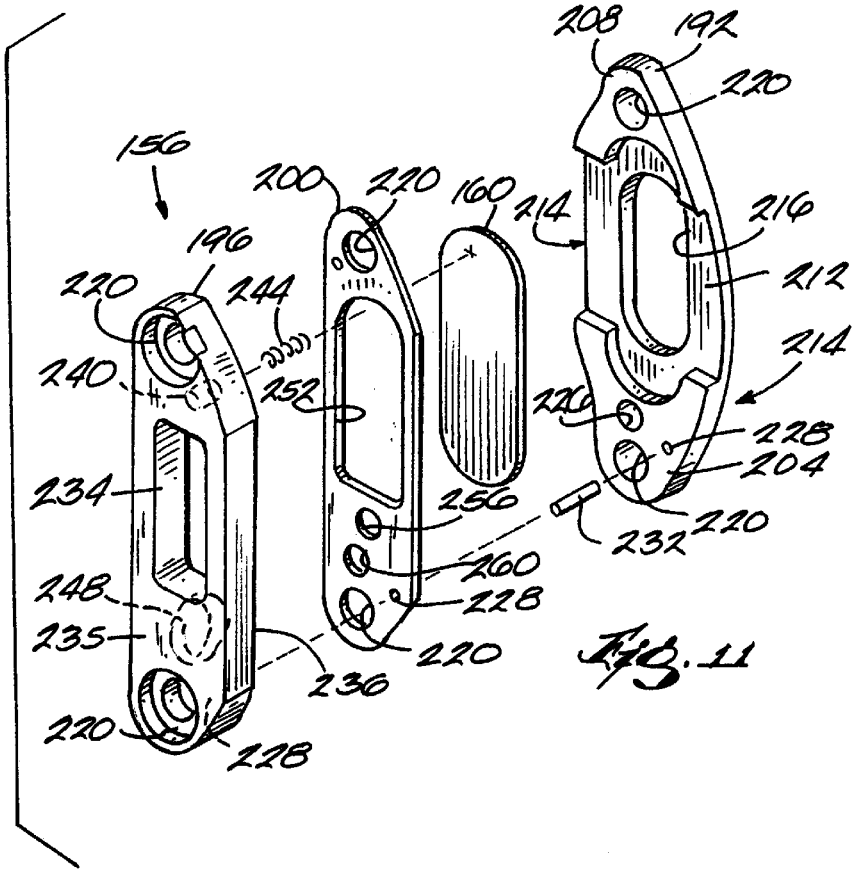
FIG. 11 is an exploded view showing the valve of FIG. 10.

FIGS. 9 and 10 are enlarged section views showing the reed valve 156 coupled to the housing 168 inside the compressor 104. FIG. 11 is an exploded view of the reed valve 156 shown in FIGS. 9 and 10. As seen in FIG. 11, the reed valve 156 includes a first valve portion 192, a second valve portion 196, an intermediate valve portion 200, and the reed 160, which are all coupled together to form the valve 156. The first valve portion 192 includes first and second end portions 204 and 208, respectively, at opposing ends of a body portion 212. The end portions 204 and 208 are thicker than the body portion 212 so that when the valve 156 is assembled, the reed 160 is retained between the end portions 204, 208 and is movable toward and away from the body portion 212. Furthermore, when the valve 156 is assembled, the difference in thickness between the body portion 212 and the end portions 204, 208 creates opposing slots 214 that communicate with the portion of the discharge line 124 downstream of the valve 156 and the rotors 108.

The body portion 212 includes an aperture 216 that is sized to communicate with the portion of the discharge line 124 adjacent the discharge end of the rotors 108. The reed 160 is sized so that when positioned against the body portion 212, the reed 160 covers the entire aperture 216. The first and second end portions 204, 208 each include an aperture 220 for receiving a mounting fastener 224 (see FIGS. 9 and 10). In addition to the mounting aperture 220, the first end portion 204 also includes a bleed line aperture 226 that communicates with the bleed line 152 when the valve 156 is mounted in the compressor 104. The first end portion 204 also includes a pin spring aperture 228 for receiving a pin spring 232 that helps to hold the valve 156 together before the valve 156 is assembled in the compressor 104.

The second valve portion 196 has a substantially uniform thickness and includes an elongated aperture 234 that extends between respective first and second surfaces 235 and 236 of the second valve portion 196. The second valve portion 196 also includes mounting apertures 220 for receiving the mounting fasteners 224 and a pin spring aperture 228 for receiving the pin spring 232. A recess 240 (shown in phantom in FIG. 11) is formed in the second surface 236 and houses a spring 244 that biases the reed 160 toward the body portion 212 of the first valve portion 192 when the valve 156 is assembled. The spring 244 facilitates movement of the reed 160 to the second position for fast closure under low-pressure-differential stopping conditions. A second, elongated recess 248 (shown in phantom in FIG. 11) is also formed in the second surface 236. The purpose of the elongated recess 248 will be described below.

The intermediate valve portion 200 is a relatively thin strip of material that is sandwiched between the first and second valve portions 192 and 196 when the valve 156 is assembled. The intermediate valve portion 200 includes mounting apertures 220 for receiving the mounting fasteners 224 and a pin spring aperture 228 for receiving the pin spring 232. Additionally, the intermediate valve portion 200 includes an elongated aperture 252 and a first bleed line aperture 256 that communicates with a portion of the elongated recess 248 in the second valve portion 196. The elongated aperture 252 and the first bleed line aperture 256 are positioned such that the reed can completely cover the elongated aperture 252 and the first bleed line aperture 256 when the reed abuts the intermediate valve portion 200. The intermediate valve portion 200 also includes a second bleed line aperture 260 that communicates with another portion of the elongated recess 248. In the illustrated embodiment, the second bleed line aperture 260 is positioned below the first bleed line aperture 256. The second bleed line aperture 260 is substantially aligned with the bleed line aperture 226 in the first valve portion 192 when the valve 156 is assembled.

Referring now to FIG. 9, when the valve 156 is assembled in the compressor 104 and the compressor 104 is shut down, the reed 160 is in the second position (corresponding to the second position shown in FIG. 5) and abuts the body portion 212, thereby closing the discharge line 124 by covering the aperture 216 that otherwise provides communication to the discharge end of the rotors 108. As described above, the reed 160 automatically moves to this second position when the compressor 104 is shut down due to the system pressure and/or the biasing spring 244. As indicated by the arrows in FIG. 9, the high-pressure refrigerant downstream of the rotors 108 and the valve 156 is free to equalize with the lower-pressure refrigerant at the suction end 116 over the pathway defined by the elongated aperture 234 in the second valve portion 196, the elongated aperture 252 in the intermediate valve member 200, the first bleed line aperture 256, the elongated recess 248, the second bleed line aperture 260, the bleed line aperture 226 in the first valve portion 192, and finally, through the bleed line 152.

Referring now to FIG. 10, when the valve 156 is assembled in the compressor 104 and the compressor 104 is running, the reed 160 is in the first position (corresponding to the first position shown in FIG. 4) and abuts the intermediate valve portion 200, thereby closing the bleed line 152 by covering the first bleed line aperture 256 in the intermediate valve portion 200. The discharge line 124 is opened and high-pressure refrigerant and lubricating oil exits the discharge end of the rotors 108, passes through the elongated aperture 216 in the first valve portion 192, exits the valve 156 laterally through the opposing slots 214 (only one is shown in FIG. 10), and continues through the discharge line 124 in the manner previously described. As described above, the reed 160 automatically moves to this first position when the compressor 104 is running due to the system pressure.

Figure 12:
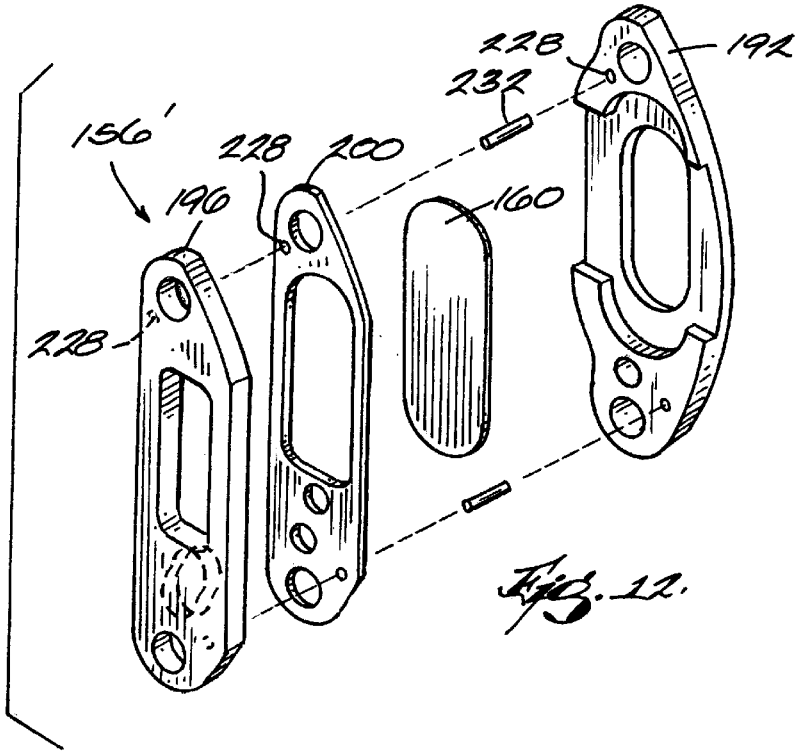
FIG. 12 is an exploded view of a valve similar to the valve shown in FIG. 11, but without a biasing spring.

FIG. 12 illustrates an alternative reed valve 156'. The reed valve 156' is substantially the same as the reed valve 156, with like parts having like reference numerals, except that the reed valve 156' does not include the biasing spring 244 and, therefore, does not include the spring recess 240 in the second valve portion 196. As discussed above, the spring 244 may not be necessary where system pressure is sufficient to automatically operate the valve 156'. The components of the spring valve 156' shown in FIG. 12 each also include a second pin spring aperture 228 for receiving a second pin spring 232.

Figure 13:
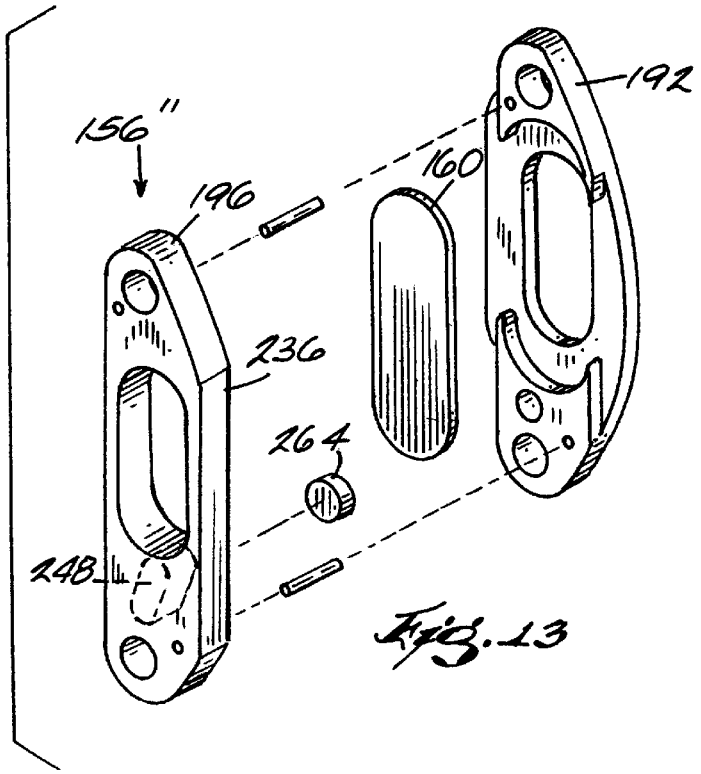
FIG. 13 is an exploded view of another valve embodying the invention.

FIG. 13 illustrates another alternative reed valve 156", with like parts indicated by like reference numerals. The reed valve 156" is different from the reed valves 156 and 156' in that the reed valve 156" does not include an intermediate valve portion 200. Rather, the reed valve 156" includes a plug 264 that is inserted into the elongated recess 248 in the second valve portion 196. The plug 264 is inserted into the middle of the elongated recess 248 until substantially flush with the second surface 236. With the plug 264 in place, the elongated recess 248 forms a U-shaped passageway without the need for the two separate bleed line apertures 156 and 160 in the intermediate valve portion 200, thereby eliminating the need for the intermediate valve portion 200.

Figure 14:
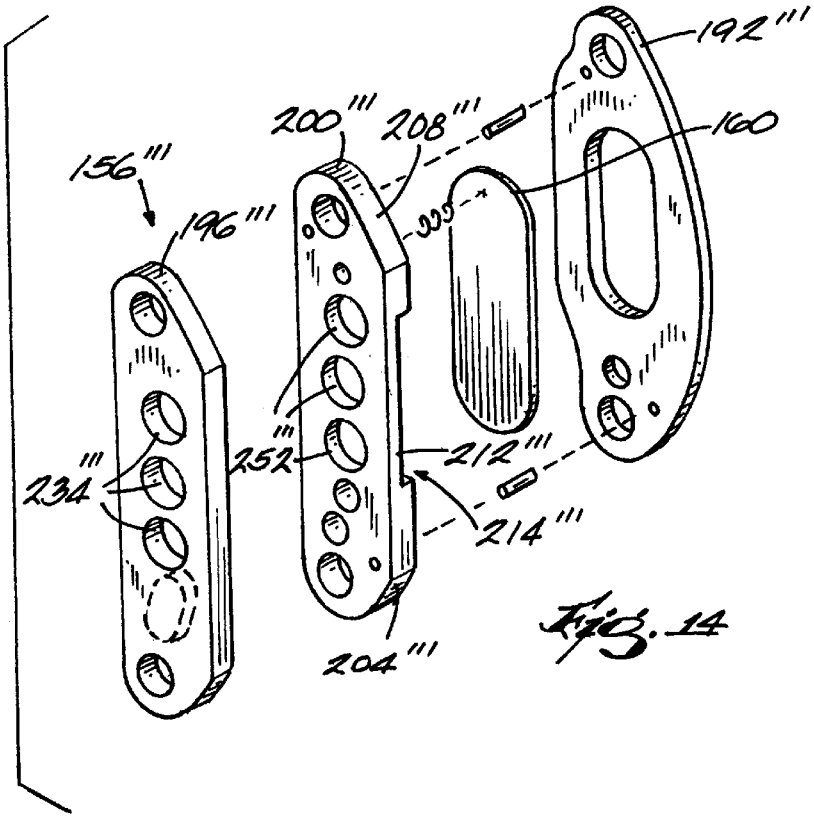
FIG. 14 is an exploded view of yet another valve embodying the invention.

FIG. 14 shows yet another alternative reed valve 156''', with like parts indicated by like reference numerals and with similar parts indicated by triple-prime (''') reference numerals . As seen in FIG. 14, the first valve portion 192''' has a substantially uniform thickness while the intermediate valve portion 200''' is thicker and includes first and second end portions 204''' and 208''', respectively, at opposing ends of a body portion 212'''. The end portions 204''' and 208''' are thicker than the body portion 212''' so that when the valve 156''' is assembled, the reed 160 is retained between the end portions 204''', 208''' and is movable toward and away from the body portion 212'''. Furthermore, when the valve 156''' is assembled, the difference in thickness between the body portion 212''' and the end portions 204''', 208''' creates opposing slots 214''' (only one is shown) that communicate with the portion of the discharge line 124 downstream of the valve 156''' and the rotors 108.

Instead of the elongated aperture 252, the intermediate valve portion 200''' includes three separate apertures 252'''. Likewise, instead of the elongated aperture 234, the second valve portion 196''' includes three separate apertures 234''' that are aligned with the apertures 252''' when the valve 156''' is assembled. Changing the elongated apertures 252 and 234 to three separate apertures 252''' and 234''' reduces the available flow area, and may be desirable for certain applications.

While several reed valves 156–156''' have been illustrated, other reed valve configurations are also contemplated by the invention. The reed valves can be made from metal or any other suitable materials. It is also understood that various other types of valves could be substituted for the reed valve configurations contemplated.

While the valve arrangement of the invention substantially reduces or eliminates the backward rotation of the rotors, it is possible that a small amount of slow backward rotation may still occur as the pressure equalizes through the oil cavities 188, which are positioned adjacent the center of the rotors 108. If desired, this small remaining backward rotation can be eliminated by opening the capacity unloader valves (not shown) that are commonly used in conjunction with screw compressors. Opening the capacity unloader valves reduces the pressure in the compression chamber 112 to the same pressure existing at the suction end 116, thereby eliminating even the smallest amount of pressure equalization occurring over the rotors 108.

Various features of the invention are set forth in the following claims.

What is claimed is:

1. A temperature control system comprising:

a condenser;

an evaporator;

a compressor coupled between the evaporator and the condenser for compressing a refrigerant circulating through the temperature control system, the compressor having a set of rotors in a compression chamber, a discharge end, and a suction end;

an oil separator communicating with the discharge end via a discharge line;

an oil sump communicating with the oil separator;

an oil supply line communicating between the oil sump and the compression chamber; and a bleed line selectively communicating between the discharge line and the oil supply line for equalizing a pressure differential across the compressor without causing substantial backward rotation of the rotors or displacement of oil to the compression chamber through the oil supply line.

2. The temperature control system of claim 1, further including a valve defining a portion of the discharge line and coupled to the bleed line.

3. The temperature control system of claim 2, wherein the valve automatically closes the bleed line when the compressor is running and automatically opens the bleed line when the compressor is shut down.

4. The temperature control system of claim 2, wherein the valve selectively opens and closes the discharge line to respectively allow and prevent communication between the discharge end of the compressor and the oil separator.

5. The temperature control system of claim 2, wherein the valve automatically opens the discharge line when the compressor is running and automatically closes the discharge line when the compressor is shut down.

6. The temperature control system of claim 2, wherein the valve includes a movable member, and wherein movement of the movable member to a first position opens the discharge line and closes the bleed line, and wherein movement of the movable member to a second position closes the discharge line and opens the bleed line.

7. The temperature control system of claim 6, wherein the movable member is a reed.

8. The temperature control system of claim 6, wherein the movable member moves between the first and second positions automatically in response to the refrigerant pressure in the temperature control system.

9. The temperature control system of claim 1, wherein the oil supply line includes a restriction so that the pressure drop over the oil supply line is larger than the pressure drop over the bleed line.

10. The temperature control system of claim 1, wherein the oil sump is lower than a point where the bleed line connects with the oil supply line so that the pressure drop over the oil supply line is larger than the pressure drop over the bleed line.

11. A compressor and oil separator assembly for compressing a fluid, the assembly comprising:

a suction end;

a discharge end;

first and second rotors rotatably mounted between the suction and discharge ends;

a discharge line communicating with the discharge end;

an oil separator communicating with the discharge line;

an oil sump communicating with the oil separator;

an oil supply line communicating between the oil sump and the rotors; and a bleed line selectively communicating between the discharge line and the oil supply line for equalizing a pressure differential between the suction end and the discharge end without causing substantial backward rotation of the rotors or displacement of oil to the rotors through the oil supply line.

12. The assembly of claim 11, further including a valve defining a portion of the discharge line and coupled to the bleed line.

13. The assembly of claim 12, wherein the valve automatically closes the bleed line when the compressor is running and automatically opens the bleed line when the compressor is shut down.

14. The assembly of claim 12, wherein the valve selectively opens and closes the discharge line to respectively allow and prevent communication between the discharge end of the compressor and the oil separator.

15. The assembly of claim 12, wherein the valve automatically opens the discharge line when the compressor is running and automatically closes the discharge line when the compressor is shut down.

16. The assembly of claim 12, wherein the valve includes a movable member, and wherein movement of the movable member to a first position opens the discharge line and closes the bleed line, and wherein movement of the movable member to a second position closes the discharge line and opens the bleed line.

17. The assembly of claim 16, wherein the movable member is a reed.

18. The assembly of claim 16, wherein the movable member moves between the first and second positions automatically in response to fluid pressure.

19. The assembly of claim 11, wherein the oil supply line includes a restriction so that the pressure drop over the oil supply line is larger than the pressure drop over the bleed line.

20. The assembly of claim 11, wherein the oil sump is lower than a point where the bleed line connects with the oil supply line so that the pressure drop over the oil supply line is larger than the pressure drop over the bleed line.

* * * * *